US006054907A

United States Patent [19]

Sjogren

[11] Patent Number: 6,054,907

[45] **Date of Patent: *Apr. 25, 2000**

[54] COUPLED GATE SWITCH FOR HIGH IMPEDANCE LOAD AND SPLIT POWER CONTROL CIRCUIT

[75] Inventor: Lance B. Sjogren, Torrance, Calif.

[73] Assignee: TRW Inc., Redondo Beach, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/993,322

[22] Filed: Dec. 18, 1997

Related U.S. Application Data

[63] Continuation of application No. 08/658,465, Jun. 5, 1996, Pat. No. 5,917,385.

[51] Int. Cl.[7] ..... H01P 1/18; H01P 1/22

[52] U.S. Cl. ..... 333/161; 333/164; 333/81 A

[58] Field of Search ..... 333/103, 104, 333/164, 81 R, 81 A, 139, 156, 160, 161, 124, 128; 330/51, 124 R, 124 D; 327/403, 404

[56] References Cited

U.S. PATENT DOCUMENTS

| | | | |
|---|---|---|---|
| 3,202,928 | 8/1965 | Prior | 330/124 R |
| 4,581,595 | 4/1986 | Silagi | 333/139 |
| 5,019,793 | 5/1991 | McNab | 333/139 X |
| 5,066,930 | 11/1991 | Morse | 333/164 |
| 5,128,639 | 7/1992 | Ueda et al. | 333/164 |
| 5,355,103 | 10/1994 | Kozak | 333/81 R |
| 5,519,349 | 5/1996 | Nakahara | 333/164 X |
| 5,541,554 | 7/1996 | Stengel et al. | 330/51 |

*Primary Examiner*—Paul Gensler
*Attorney, Agent, or Firm*—Michael S. Yatsko

[57] ABSTRACT

A split power control circuit includes a solid state switch and a circuit or circuit element, such as a relatively large resistance or reactance connected between an RF signal line and ground. In order to provide relatively more precise control and thus relatively finer adjustment of the RF signal line, the RF signal line is split into a plurality of branches, with the switched control circuit or element connected to one or more of the branches. In another embodiment of the present invention, a solid state switch and serially connected circuit or circuit element, such as a resistance or reactance, are connected between an RF signal line and ground. The gate terminal of the solid state switch is capacitively coupled to the switch terminal (i.e. drain or source) connected to the RF signal line, forcing the gate bias element to become a fixed, rather than switched, load, thereby minimizing errors due to the gate biasing element and enabling tuning reactances to be used to compensate for such gate loads.

13 Claims, 4 Drawing Sheets

COUPLED GATE SWITCH FOR HIGH IMPEDANCE LOAD AND SPLIT POWER CONTROL CIRCUIT

This is a continuation, of application Ser. No. 08/658,465, filed Jun. 5, 1996, now U.S. Pat. No. 5,917,385.

This invention was made with Government support under Contract No. F30602-95-0075 awarded by the Department of Defense. The Government has certain rights in this invention.

BACKGROUND OF THE INVENTION

1. Field of the Invention

The present invention relates to a control circuit for controlling a radio frequency (RF) signal and, more particularly, to a split power control circuit for providing relatively precise control of an RF signal. In order to provide relatively more precise control to provide relatively fine adjustment, the RF signal is split into a plurality of branches. A switched circuit or circuit element is connected to one or more of the branches of the RF signal line to provide relatively fine adjustment of the RF signal. The split power control circuit may be implemented as a switch, such as a solid state switch, and a serially connected circuit or circuit element, such as a resistance or reactance to provide relatively precise amplitude or phase control, respectively, of an RF signal line. In another embodiment of the invention, a solid state switch and a serially connected circuit or circuit element, such as a resistance or reactance, are connected between an RF signal line and ground. The gate terminal of the switch is capacitively coupled to the switch terminal (i.e. source or drain) connected to the RF signal line, forcing the gate biasing element to be fixed rather than switched load to improve circuit performance.

2. Description of the Prior Art

Various microwave and millimeter wave electronic systems which require relatively precise amplitude and/or phase control are known. Examples of such electronic system include bear, steering phased arrays, nulling antennas, as well as multibeam antennas. Such electronic systems are known to employ monolithic microwave integrated circuits (MMICs) for amplitude and phase control functions. Such circuits are known to be implemented using either continuously variable (analog) circuits or stepped (digital) circuits. Digital control circuits are known to be often preferred, since such circuits can provide relatively lower levels of intermodulation products, are less temperature and process sensitive, require less calibration, and can be implemented with standard MMIC devices, such as a MESFET or HEMT.

A known attenuator circuit is illustrated in FIG. 1. Such a circuit is known as a loaded-line attenuator and includes a solid state switch, such as a HEMT having gate, drain and source thrills, for connecting and disconnecting a relatively high resistance load between an RF signal line and ground. The switched resistance is known to be selected to be relatively large to make it essentially transparent to the RF signal line to which it is coupled. Gate bias elements are connected to the gate of the HEMT. Such gate bias elements are known to include either a relatively large resistor or a quarter-wave bias stub, as illustrated in FIGS. 2 and 3. A control voltage Vct1 is applied to the resistor or quarter-wave bias stub which, in turn, controls the HEMT to connect the high impedance load to the RF line.

In order to provide relatively high precision amplitude and phase control, switched attenuators and phase shifting circuits must be able to provide fine as well as coarse amplitude and phase increments. The minimum amplitude and phase increments are known to be limited as discussed below.

In order to obtain relatively high-precision control from a loaded-line attenuator, a relatively large switched resistor is employed. For very high precision (i.e. fine-resolution), it is found that the loaded-line attenuator cannot provide good RF performance; more specifically, it cannot provide low-phase error. (Phase error is defined as the difference in phase of the transmitted RF signal with the attenuator in the "on" versus "off" states.) This is due to the fact that the source terminal of the solid state switch and the load resistor possess a certain unavoidable capacitance to ground. When the solid state switch is "on", these capacitances are "seen" as part of the load being switched, and introduce a phase shift. In addition, the bias circuitry as discussed below has similar parasitic effects.

Thus, beyond a certain level of resolution, the performance of a loaded-line attenuator degrades. In addition, there is a certain limit of resolution beyond which the loaded-line attenuator cannot reach, even with degraded phase error. This is due to the fact that the solid state switch does not provide an infinite impedance in its "off" state, and, in addition, the fact that the load resistor cannot achieve an infinitely high-impedance value, due to the parasitic capacitances to ground of the load resistor and the terminal of the solid state switch on the load end. In summary, beyond a certain level of resolution, the loaded-line attenuator provides degraded RF performance. Moreover, at a relatively higher level of resolution, the loaded-line attenuator reaches a limit beyond which it cannot achieve greater resolution.

A resolution limit also applies to the loaded-line phase shifter. The loaded-line phase shifter operates by employing a solid state switch to connect or disconnect a capacitive load to an RF line. However, even with no capacitive load, there is some effective load capacitance, due to the capacitance to ground of the load end of the solid state switch. The finite impedance of the solid state switch also contributes to this resolution limit. If the switched capacitive load approached an infinite impedance, then the impedance of the "off" state of the solid state switch becomes relatively low in comparison to that of the load, so that the load will appear to be "switched on", whether the solid state switch is in its on or off state. In summary, the finite impedance of the switched capacitive load, as well as that of the solid state switch, result in a limit on the resolution achievable by a loaded-line phase shifter. As for the loaded-line attenuator, parasitic effects of the bias circuit, as described below, contribute further to this performance limitation.

More specifically, as shown in FIG. 2, a relatively large MMIC resistor is known to be used as a gate bias element. Such an MMIC resistor will exhibit a relatively high impedance. However, the impedance cannot be selected to be arbitrarily large, because the physical structure of the resistor is such that it does not behave electrically as a pure resistance. Rather, it behaves as a network of distributed series resistances and shunt capacitances to ground. Using standard FET switch topology, the gate resistor behaves as a switched capacitive load in parallel with the intended switched load is the circuit. This is due to the fact that it is electrically coupled to the intended switched load through the gate-source capacitance of the FET. As used in an attenuator circuit, this parasitic load induces a phase error which cannot be tuned out. In the case of a phase shifting circuit, the gate bias resistor can introduce additional phase shift which limits the minimum phase shift that can be achieved with the circuit topology.

As mentioned above, a quarter-wave bias stub can also be used as a gate bias element for the HEMT. Such a quarter-wave bias stub can be made to exhibit essentially infinite impedance at the center frequency of circuit operation. However, the impedance of the quarter-wave bias stub drops to a finite impedance at frequencies off the center frequency. As such, in a loaded line-type attenuator, the quarter-wave stub introduces phase error, except at the design center frequency.

In a loaded-line phase shifter, it introduces a variation of phase shift as a function of frequency, which is generally deleterious to the performance of the system in which it is used.

SUMMARY OF THE INVENTION

It is an object of the present invention to solve various problems in the prior art.

It is yet another object of the invention to provide an attenuator control circuit which allows for relatively smaller adjustment increments than known attenuator control circuits.

It is a further object of the invention to provide a switched phase shifting circuit which allows for relatively smaller adjustment increments than known phase shifting circuits.

Briefly, the present invention relates to attenuator control circuits for use in various microwave and millimeter wave electronic systems which require precision amplitude control. The attenuator control circuits include one or more switched attenuators. In one embodiment of the present invention, the RF line is split into two branches, with a switched attenuator connected to one or both branches. With such a configuration, relatively more precise amplitude control is possible relative to known circuits. In another embodiment of the present invention, the solid state switch implemented as a HEMT having gate, drain and source terminals is configured such that the gate and drain terminals are capacitively coupled together, forcing the gate loads to become a fixed, rather than switched load, thereby minimizing errors and enabling tuning reactances to be used to compensate for gate loads. In alternate embodiments of the invention, the resistances are substituted with reactive loads to form precision switched phase shifting circuits.

BRIEF DESCRIPTION OF THE DRAWING

These and other objects of the present invention will be readily understood upon consideration of the following detailed description and attached drawing, wherein.

DETAILED DESCRIPTION OF THE INVENTION

Figure 1:
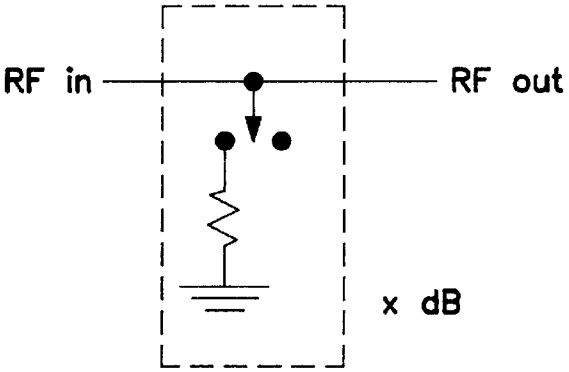
FIG. 1 PRIOR ART
FIG. 1 is a schematic diagram of a known loaded-line switched attenuator which illustrates a solid state switch and a high resistance load.
Figure 2:
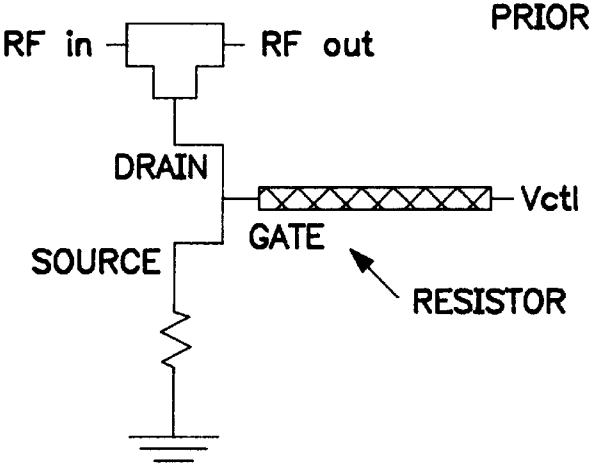
FIG. 2 PRIOR ART
FIG. 2 is similar to FIG. 1, illustrating the use of a high electron mobility transistor (HEMT) for the solid state switch and a resistor as a gate biasing element.
Figure 3:
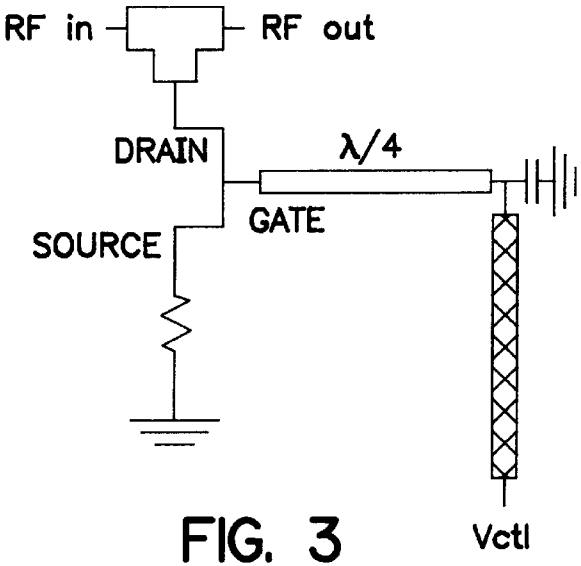
FIG. 3 PRIOR ART
FIG. 3 is similar to FIG. 2, illustrating a quarter-wave guide as a gate biasing element.
Figure 4:
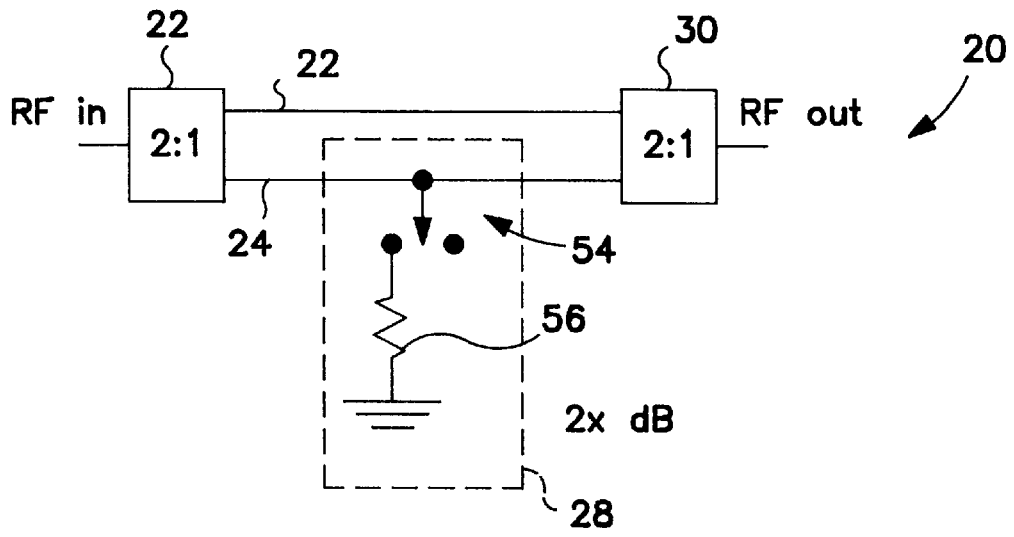
FIG. 4 is a schematic diagram of an attenuator control circuit in accordance with the present invention, illustrating the use of a split RF signal line and a switched attenuator coupled to one branch of the RF signal line.
Figure 5:
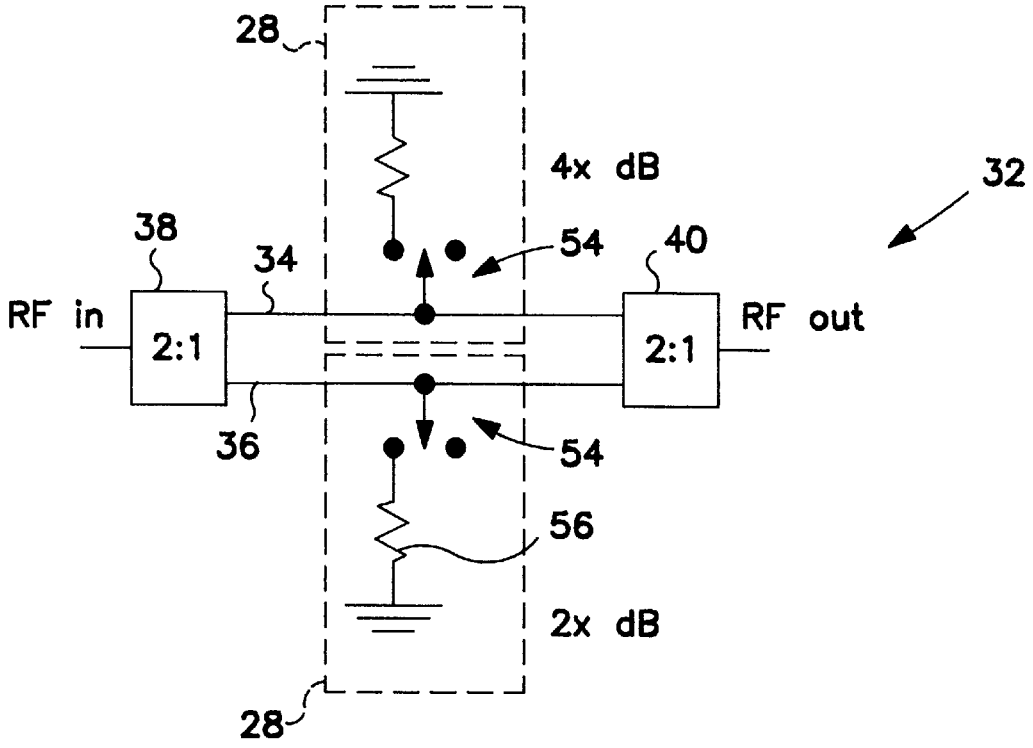
FIG. 5 illustrates an alternate embodiment of the invention illustrated in FIG. 4, illustrating a switched attenuator coupled to each branch of the RF signal line.
Figure 6:
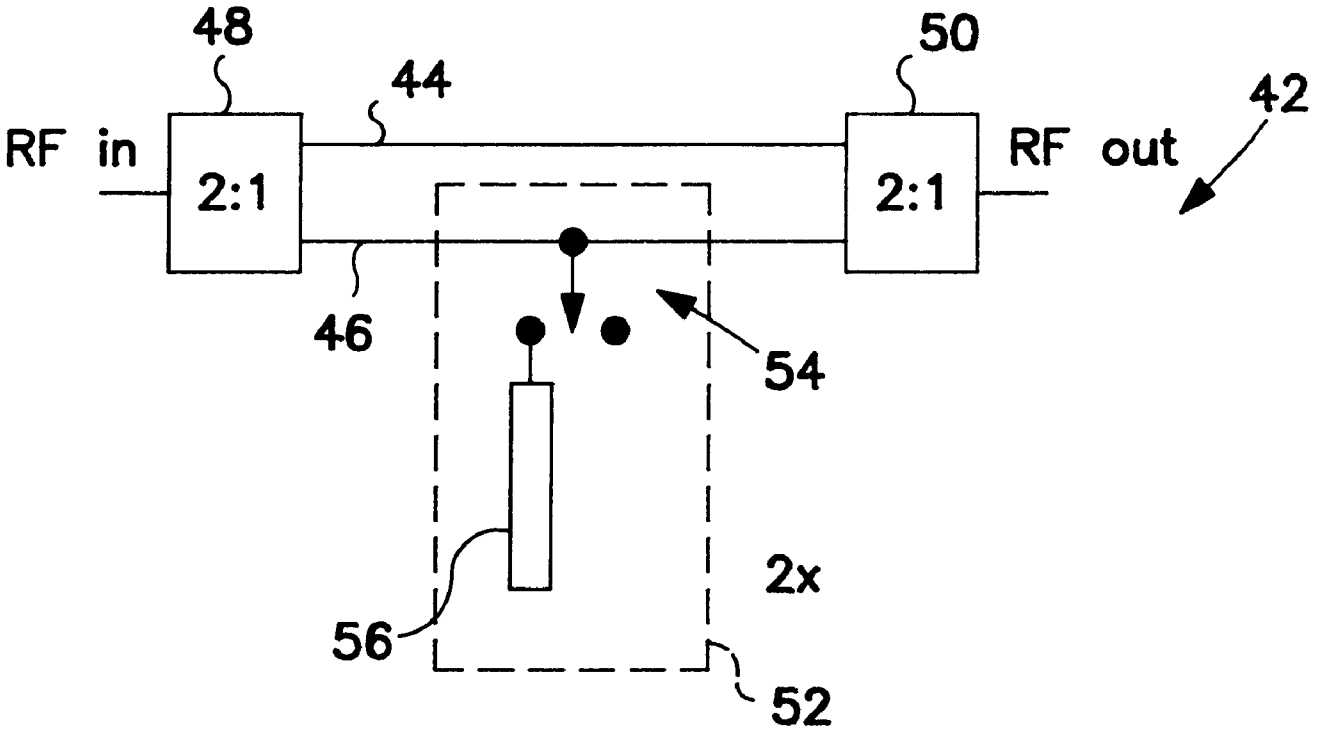
FIG. 6 is similar to FIG. 4, except that a reactive load is substituted for the high resistance element forming a precision-switched phase shifting circuit.

The present invention, illustrated in FIGS. 4–6, relates to a split power control circuit wherein the RF signal line is split into a plurality of branches, for example, two branches, and a solid state switch and a serially connected circuit or circuit element is connected between one or more of the branches and ground to provide relatively precise control and thus a relatively finer adjustment of the RF signal line. The RF branches are recombined downstream of the switched control circuits or elements.

FIGS. 4 and 5 illustrate a split power control circuit in accordance with the present invention, implemented as a switched attenuator circuit, wherein the RF signal line is split into a plurality of branches and an attenuator is connected to one or both branches. FIG. 6 is an alternative embodiment of the invention illustrated in FIGS. 4 and 5 and relates to a precision switched phase shifting circuit in accordance with the present invention.

Figure 8:
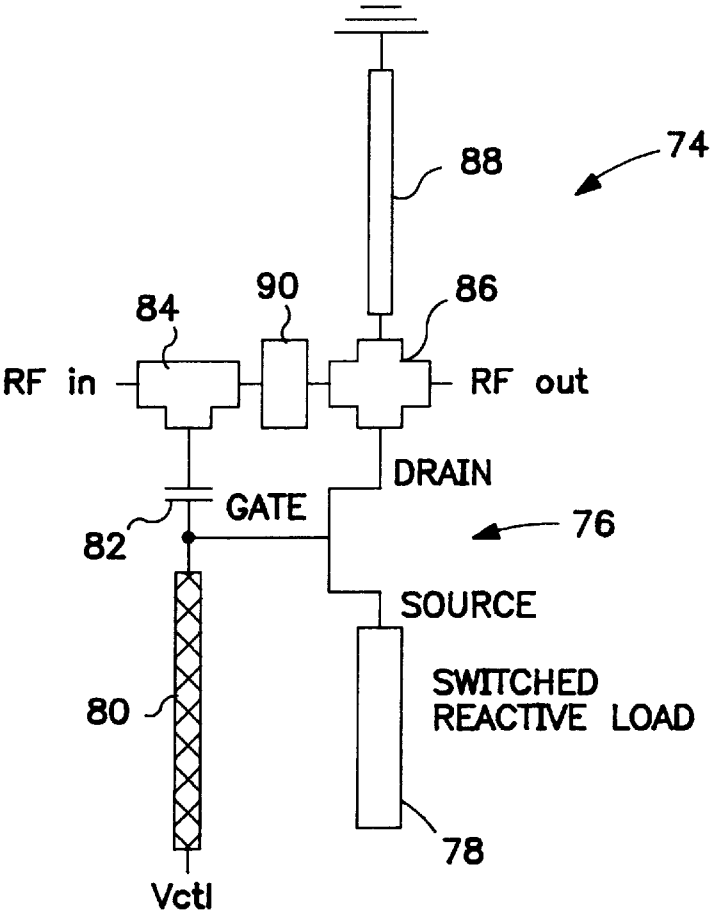
FIG. 8 is similar to FIG. 7, illustrating the use of a switched reactive load connected to the RF signal line, forming an alternative precision-switched phase- shifting control circuit.
Figure 7:
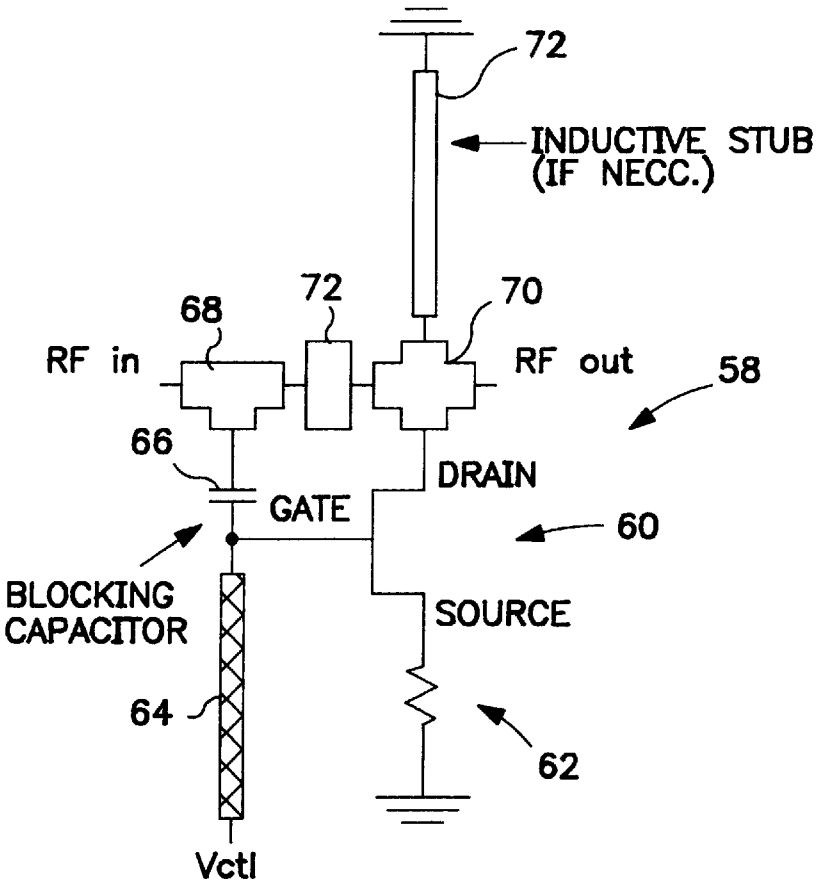
FIG. 7 is a schematic representation of a switched attenuator control circuit in which the gate and drain terminals of the solid state switching device are capacitively coupled together in accordance with the present invention.

FIGS. 7 and 8 illustrate another alternate embodiment of the invention, where the RF signal line is not split and a control circuit which includes a solid state switch and a serially coupled circuit or circuit element is connected between the RF signal line and ground. In order to reduce the parasitic effects of the bias element used to bias the gate of the solid state switch, the gate terminal of the solid state switch is capacitively coupled to the switch terminal (i.e. drain or source) connected to the RF signal line in order to force the gate bias element to be a fixed rather than a switched load, which enables any errors resulting from the impedance of the gate bias element to be tuned out.

The attenuator control circuits, illustrated in FIGS. 4, 5 and 7, as well as the phase shifting control circuits illustrated in FIGS. 6 and 8, provide relatively precise amplitude and phase control, respectively, relative to known attenuator and phase shifting control circuits. As such, the attenuator and phase shifting control circuits in accordance with the invention are suitable for various microwave and millimeter wave electronic systems which require relatively precise amplitude and/or phase control, such as phased arrays, nulling antenna, as well as a multibeam antenna.

Referring first to FIG. 4, the attenuator control circuit is generally identified with the reference numeral 20. An important aspect of the circuits illustrated in FIGS. 4–6, is that the RF signal line is split into two branches 22 and 24 by a signal splitter 26, for example a so-called Wilkinson splitter, which may be monolithically integrated with the attenuator circuit. The switched attenuator, shown within the dashed box identified with the reference numeral 28, is connected to one branch 24, while RF power in the other branch 22 flows uninterrupted. The power from the two branches 22 and 24 is then recombined by a signal recombiner 30, for example a monolithic Wilkinson splitter hooked up in the reverse traction.

Since the switched attenuator 28 only operates on one-half of the total RF signal (i.e., one branch), the attenuator 28 would have to attenuate double to achieve a given attenuation level for the entire RF signal. For example, if a 0.3 dB attenuator is used for the switched attenuator 28, the overall RF signal would only be attenuated by 0.15 dB.

Design of a 0.3 dB attenuator with relatively good RF performance is known in the art. However, the design of a relatively finer increment attenuator, such as a 0.15 dB attenuator, is relatively difficult. As such, by splitting the RF signal into two branches, 22 and 24, and attenuating only one of the branches, 22 or 24, a robust 0.3 dB attenuator 28 can be utilized to provide a relatively finer 0.15 dB increment.

The split power technique illustrated in FIGS. 4–6 can also be used to reduce RF insertion loss, since only a portion of the power in the branch containing the attenuator element is subject to its insertion loss. However, for a large valued attenuator, the attenuation element will require a somewhat different value than 2× dB in order to achieve an overall attenuation of ×dB.

An alternate embodiment of the invention is shown in FIG. 5 and generally identified with the reference numeral 32. In this embodiment, the RF signal is split into two, for example, equal-power branches 34 and 36 by a signal splitter 38 and recombined by a signal recombiner 40. A switched attenuator 28 is connected to each of the branches 34 and 36. For relatively small attenuation levels, the configuration illustrated in FIG. 5 will operate essentially the same as a cascaded pair of attenuators. For example, with a 0.3 dB attenuator in one branch and a 0.6 dB attenuator in the other, the overall circuit provides attenuation steps of 0.15 dB, 0.3 dB and 0.45 dB. In addition, the RF insertion loss will generally be lower because the RF power only passes a single attenuator element, rather than two. At relatively high attenuation levels with both switched attenuator circuits conducting, the operation of the pair of switched attenuators 28 will deviate from that of a pair of cascaded switched attenuator circuits.

In addition, the circuits of FIG. 4 and FIG. 5 can be extended by splitting the power into more than two branches. For example, a 4-bit attenuator could be achieved by splitting the power into four branches, each with an attenuator on it.

A phase shifting control circuit for controlling the phase of an RF signal line, generally illustrated with the reference numeral 42, is illustrated in FIG. 6. The phase shifting control circuit 42 operates primarily on the same principles as the attenuator control circuits 20 and 32, illustrated in FIGS. 4 and 5, respectively. In particular, an RF signal is split into two branches 44 and 46 by a signal splitter 48. The branches 44 and 46 are then recombined by a signal recombiner 50. A switched phase shifting circuit shown within the dashed box 52 is connected to one of the branches 44 or 46. Since the switched phase shifting circuit 52 is only coupled to one of the branches 44 or 46, relatively finer phase shifting increments are possible.

The switched attenuators 28 include a solid state switch 54 and a resistance 56. The solid state switch 54 is shown as a single-pole, double-throw contact having a first position which connects the resistance 56 to one of the branches of the RF signal line, and second position where the resistance 56 is disconnected from the RF signal line. The solid state switch 54 may be implemented as a metal semiconductor field effect transistor (MESFET) or a high electron mobility transistor (HEMT). As will be appreciated by those of ordinary skill in the art, the principles of the invention are applicable to virtually any type of solid state switch. As will be discussed in more detail below, the source and drain terminals of either a MESFET or HEMT are used as the switch, while the gate terminal is used to control the switching of the solid state switch 54 to either connect or disconnect the resistance 56.

The gate terminals of the solid state switches 54 may be digitally controlled to switch the solid state switches 54 either on or off. As such, the attenuator control circuit 20, illustrated in FIG. 4, could be considered a one-bit attenuator, since one bit may be used to control the on and off states of the solid state switch 54. The attenuator control circuit 32, illustrated in FIG. 5, may be considered a two-bit attenuator circuit, since one bit would be used for each of the switched attenuators 28.

The resistances 56 which form a portion of the switched attenuator circuits 28 may be implemented as monolithic microwave integrated circuits (MMIC). The resistances 56 may also be implemented as quarter-wave tuning stubs or other types of bias stubs.

The switched phase shifting circuit 52 illustrated in FIG. 6 includes a solid state switch 54 and a tuning element 56. The solid state switch 54 may be implemented as either a MESFET or a HEMT. The tuning element 56 may be implemented, for example, as a tuning stub or other reactive load.

As discussed above, the RF power in each of the circuits 20. 32 and 42 is split into two branches of equal power. However, the principles of the present invention are also applicable to embodiments in which the splitters 26, 38 and 48 provide RF signal branches of unequal power. With unequal power branches, even greater precision is possible. For example, if the power between the two branches is split 3:1 and a 0.3 dB attenuator is attached to the lower power branch, a relatively fine adjustment of 0.075 dB is possible.

Alternate embodiments of the invention are illustrated in FIGS. 7 and 8. Both of the embodiments illustrated in FIGS. 7 and 8 include switched attenuators which include a solid state switch, such as a HEMT or MESFET, and an impedance. These embodiments may be used with an individual RF signal line as illustrated in FIGS. 7 and 8, or with a split RF signal line as illustrated in FIGS. 4–6.

As mentioned above, the solid state switches are normally implemented as HEMTs or MESFETs. The drain and source terminals of the HEMTs or MESFETs are used to switch the impedance between the RF signal line and ground. The gate terminal of the HEMT or MESFET is used for control. Typically, a gate bias element, such as an MMIC resistor or a quarter-wave stub, is used as a gate bias element and is serially coupled to the gate terminal. A control voltage, for example a digital signal, identified in the Figures as Vct1, is applied to the gate bias element to control the gate which, in turn, controls the switching of the drain and source terminals of the HEMT or MESFET. With such configuration, the gate bias element, for example am MMIC resistor, behaves as a switched capacitive load in parallel with the intended switched impedance that forms part of the switched attenuator circuits. As such, the gate biasing resistor acts as a parasitic load which induces a phase error which cannot be tuned out. In the case of a switched phase shifting circuit, an additional phase shift is introduced which limits the minimum phase shift that can be achieved.

In some known switched attenuator circuits, a quarter-wave bias stub is used as a gate biasing element. Such quarter-wave biasing stubs exhibit essentially infinite impedance at the center frequency of circuit operation, but drops to a finite impedance away from the center frequency. In a loaded line attenuator, the quarter-wave stub introduces a phase error at all frequencies except the design center frequency.

In the embodiment of the invention illustrated in FIGS. 7 and 8, the gate of the solid state switching device 60, 76 is RF-coupled to the drain terminal by way of a blocking capacitor. With such a configuration, the gate biasing element 64, 80 is strongly coupled to the drain, irrespective of whether the solid state switch 60, 76 is on or off. As such, the gate biasing element 64, 80 becomes a fixed, rather than a switched, load. Consequently, a tuning reactance can be used to compensate for the load of the gate biasing element.

Referring to FIG. 7, an attenuator control circuit is illustrated, generally identified with the reference numeral 58. The attenuator control circuit 58 includes a solid state switch 60, such as a HEMT or MESFET having gate, source and drain terminals. The drain terminal of the HEMT 60 is connected to the RF signal line, while the source terminal is connected to ground by way of a resistance 62. The gate terminal of the HEMT 60 is connected to a gate biasing element 64, which may be an MMIC resistor or a quarter-wave tuning stub as discussed above. In accordance with an important aspect of the invention, the gate terminal of the HEMT 60 is RF-coupled to the drain terminal by way of a blocking capacitor 66. As mentioned above, by RF coupling the gate terminal of the HEMT to its drain terminal, the gate biasing element 64 becomes a fixed rather than a switched, load, which improves system performance. A control signal Vct1, which may be a digital signal, is applied to the gate biasing element to control the HEMT 60.

In this embodiment of the invention, a single RF signal line is used. As shown, connections between the capacitor 66 and the RF signal line may be by way of a three-way RF coupling device 68, for example a monolithically integrated microstrip "TEE". Connections between the HEMT 60 and the RF signal line may be made by way of a four-way RF coupling device 70, for example a monolithically integrated microstrip "cross". An inductive tuning stub 72 may be connected between one of the legs of the four-way coupling device 70 and ground, if necessary. The three-way RF coupling device 68 and four-way RF coupling device 70 may be connected by way of a two-way coupling device 72, which may be implemented as a length of monolithically integrated microstrip line.

A switched phase shifting circuit in accordance with the present invention, generally identified with the reference numeral 74, is illustrated in FIG. 8. The switched phase shifting circuit 74 includes a solid state switch 76, for example a HEMT or a MESFET, which includes drain, source and gate terminals, and a switched reactive load 78. The gate terminal of the HEMT 76 is connected to a gate biasing element 80, which may be either an MMIC resistor or a quarter-wave tuning stub as discussed above. In order to improve the performance of the switched phase shifting circuits 74, the gate terminal of the HEMT 76 is RF-coupled to the drain terminal by way of a blocking capacitor 82. A control voltage VCTL, for example a digital signal, may be applied to the gate biasing element 80 to control the operation of the HEMT or MESFET 76.

Connections between the capacitor 82 and the RF signal line are made by way of a three-way RF coupling device 84. The HEMT 76 is connected to the RF signal line by way of a four-way RF coupling device 86. An inductive tuning stub 88 may be connected between one leg of the four-way RF coupling device 86 and ground, if necessary. The three-way RF coupling device 84 is coupled to the four-way RF coupling device 86 by way of a two-way RF coupling device 90.

The circuits 58 and 74 described above avoid serious performance degradation which normally occurs when using conventional HEMTs for a high-precision loaded line attenuator or phase shifter. An important aspect of the invention illustrated in FIGS. 7 and 8 is that, instead of utilizing a relatively high impedance for the gate biasing elements 64 and 80 to make the impedance transparent to the RF signal line, the load of the gate biasing elements 64 and 80 are coupled to the RF signal line by way of a blocking capacitor. With such configuration, the effect of the impedance of the gate biasing elements 64 and 80 is no longer deleterious, since the load is now fixed and unswitched.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An attenuator for selectively attenuating an RF signal line carrying an RF signal; the attenuator comprising:

a signal splitter for splitting said RF signal line into a plurality of branches, the signals in said plurality of branches each having the same phase, each branch continuously carrying a predetermined portion of said RF signal;

one or more switched attenuators connected to one or more of said branches, each switched attenuator including a first solid state switch and a serially coupled first resistance, said first resistance coupled between one of said branches and ground, said first solid state switch for selectively coupling said first resistance to one of said branches for selectively attenuating the amplitude of said RF signal in said branch; and a signal recombiner for combining said plurality of branches together and forming a single RF signal line.

2. An attenuator as recited in claim 1, wherein said plurality is two.

3. An attenuator as recited in claim 1, wherein said signal splitter is selected such that each of said branches are of equal power.

4. An attenuator as recited in claim 1, wherein said signal splitter is selected such that each of said branches are of unequal power.

5. The attenuator is recited in claim 1, wherein said solid state switch is a MESFET.

6. The solid state switch as recited in claim 1, wherein said solid state switch is a HEMT.

7. The attenuator as recited in claim 1, wherein said resistance is formed from a $\lambda/4$ tuning stub.

8. A phase shifter for selectively varying the phase of an RF signal line carrying an RF signal having a predetermined phase characteristic, the phase shifter comprising:

a signal splitter for splitting said RF signal line into a plurality of branches, the signals in said plurality of branches each having the same phase, each branch continuously carrying a predetermined portion of said RF signal line;

one or more phase shifting devices, each phase shifting device including a first solid state switch and a serially coupled first impedance, said first impedance including a reactance component, each phase shifting device coupled between said first solid state switch and ground, said first solid state switch for selectively coupling said first impedance to one of said branches for varying the phase of said RF signal in said branch; and a signal recombiner for combining said plurality of branches together and forming a single RF signal line.

9. A phase shifter as recited in claim 8, wherein said plurality is two.

10. A phase shifter as recited in claim 8, wherein said signal splitter is selected such that each of said branches are of equal power.

11. A phase shifter as recited in claim 8, wherein said signal splitter is selected such that each of said branches are of unequal power.

12. A phase shifter as recited in claim 8, wherein said solid state switch is a MESFET.

13. A phase shifter as recited in claim 8, wherein said solid state switch is a HEMT.

* * * * *